US006517410B1

(12) United States Patent
Underhill

(10) Patent No.: US 6,517,410 B1
(45) Date of Patent: Feb. 11, 2003

(54) SPORTS BRA WITH FLOATING STORAGE POUCH

(76) Inventor: Annette K. Underhill, P.O. Box 600, Russellville, AR (US) 72811

( * ) Notice: Subject to any disclaimer, the term of this patent is extended or adjusted under 35 U.S.C. 154(b) by 0 days.

(21) Appl. No.: 09/832,744

(22) Filed: Apr. 11, 2001

(51) Int. Cl.[7] ..... A41C 3/00
(52) U.S. Cl. ..... 450/1; 450/89
(58) Field of Search ..... 450/89, 1, 65, 450/66, 67, 70, 92; 2/247–251, 243.1

(56) References Cited

U.S. PATENT DOCUMENTS

| | | | | | |
|---|---|---|---|---|---|
| 2,492,862 | A | * | 12/1949 | Harvey | 450/89 |
| 2,503,847 | A | * | 4/1950 | Shanahan | 450/89 |
| 2,593,711 | A | * | 4/1952 | Weatherly | 450/89 |
| 2,624,881 | A | * | 1/1953 | Lee | 450/89 |
| 3,078,852 | A | * | 2/1963 | Stapleton | 450/89 |
| D241,189 | S | * | 8/1976 | Clark | 450/89 |
| 4,815,510 | A | * | 3/1989 | Edelist | 450/89 |
| 5,067,178 | A | * | 11/1991 | Katchka | 450/89 |
| 5,496,205 | A | * | 3/1996 | Lee | 450/89 |
| 5,573,441 | A | * | 11/1996 | Smith | 450/89 |
| 6,176,761 | B1 | | 1/2001 | Underhill | 450/89 |

* cited by examiner

*Primary Examiner*—Gloria M. Hale
(74) *Attorney, Agent, or Firm*—Frank J. Catalano

(57) ABSTRACT

The front portion of a sports bra has a lining and a decorative cloth. A flat pocket lays over the opposite side of the lining as the decorative cloth. A cloth cover lays over the pocket. The bottom of the pocket is seamed to the bottom of the cover without stitching the lining or the decorative cloth and the sides of the cover are seamed to the lining without stitching the pocket or the decorative cloth so that the pocket floats in relation to the lining and decorative cover. The lining and cover are of universally stretchable absorbent material and the decorative cloth is of universally stretchable wicking material. The stretch affords the desired support from the bra, the absorbency collects the wearer's perspiration and the wicking draws the absorbed moisture to the outside for evaporation. The floating pocket provides a comfortable pouch for concealing articles within the bra.

40 Claims, 5 Drawing Sheets

Fig. 2
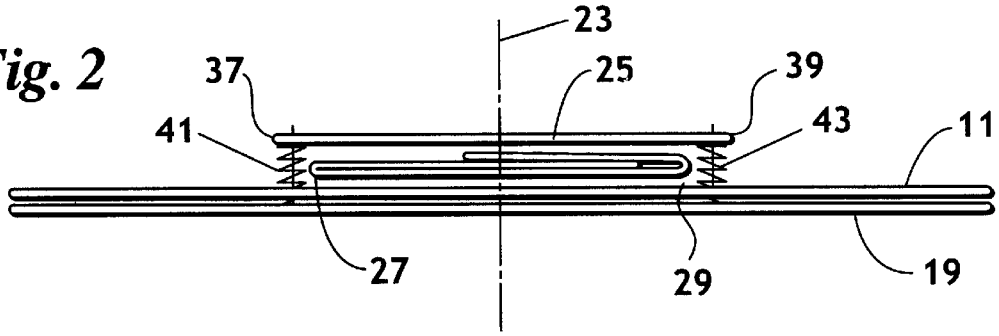
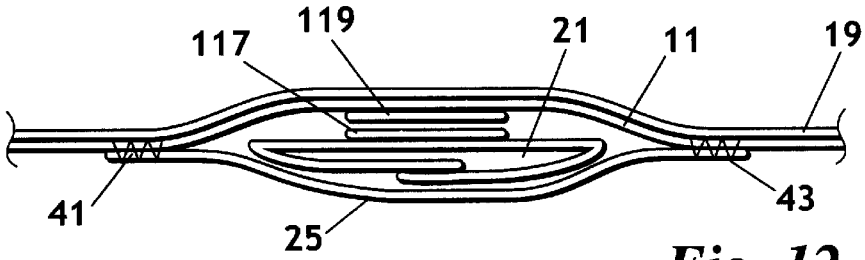
Fig. 12
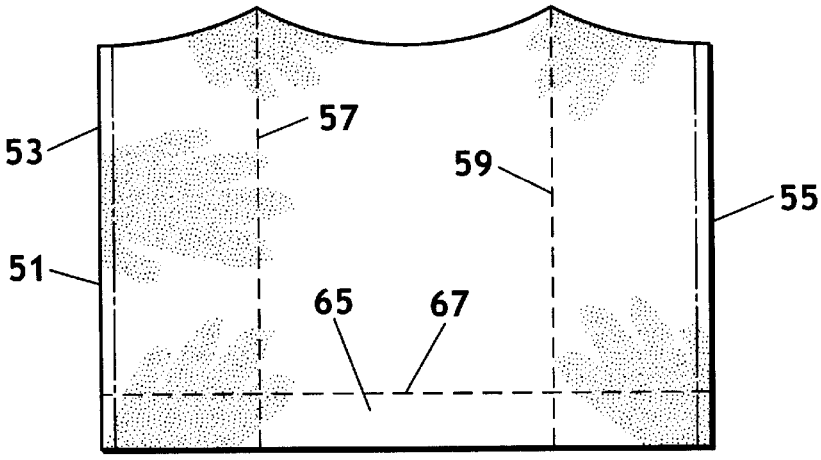
Fig. 6
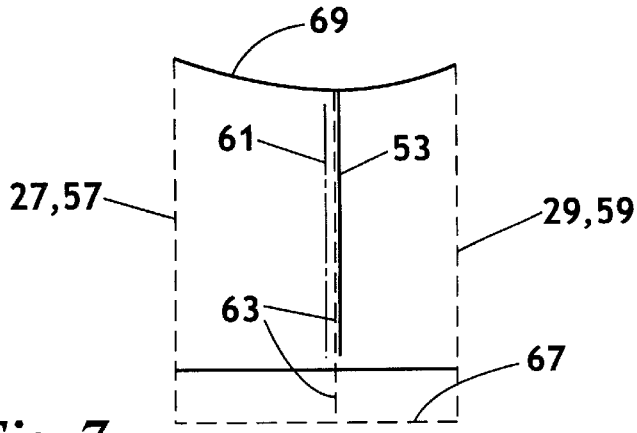
Fig. 7

SPORTS BRA WITH FLOATING STORAGE POUCH

BACKGROUND OF THE INVENTION

This invention relates generally to clothing and more particularly concerns women's undergarments.

The inclusion in the structure of a bra of concealed pouches for storing various types of articles has long been known. Bras with externally attached storage cases are generally conspicuous and disruptive of the figure line. Bras with compartments accessible from the inside are more aesthetically appealing but are less comfortable and accessible. Zippered compartments inside the bra improve aesthetics and accessibility but, because of inelasticity, render the bra uncomfortable and not well suited to its purpose.

In my U.S. Pat. No. 6,176,761, many of these problems were partly, if not completely, resolved. Some problems, however, remain. Perspiration readily passes through fabric holes caused by stitching and also migrates in absorbent materials. Thus, although a pouch may be made of waterproof material, moisture can still find a path to its concealed contents. On the other hand, while pockets made of waterproof material help to protect their contents from moisture, waterproof material has minimal, if any, stretchability. This diminishes the benefits of support and comfort afforded by the stretchable qualities of the bra lining and decorative layers. Furthermore, combinations of absorbent stretchable linings and layers with non-stretching waterproof pockets require stitching, seaming and hemming, all of which draw attention to, rather than conceal, the pouch and its contents. All of these problems are exacerbated by the very nature of a sports bra which provides support by means of snug elasticity. The resulting tension in the bra tends to accentuate every deviation from a smooth surface, to enlarge every stitch hole and to accelerate migration of moisture.

It is, therefore, an object of this invention to provide a sports bra which has a pocket of waterproof material which floats within its stretchable structure so as to enhance support and comfort. Another object of this invention is to provide a sports bra which has a waterproof pocket seamed to the bra only at the neckline so that the pocket is otherwise free to move independently of the bra. A further object of this invention is to provide a sports bra which helps to disguise the presence of a storage pouch and its contents. Yet another object of this invention is to provide a sports bra which uses decorative gathering of material to hide the contours of seams and hems and concealed articles. It is also an object of this invention to provide a sports bra which avoids layering of seams which would increase the detectability of the storage pouch in the bra. Still another object of this invention is to provide a sports bra which has a storage pouch formed by folding so as to avoid detectable side seams. An additional object of this invention is to provide a sports bra which has a storage pouch separated from the wearer by a moisture absorbing cover. Another object of this invention is to provide a sports bra with an interior cover for a concealed pouch which is flat seamed to the bra lining to reduce the likelihood of detectability. A further object of this invention is to provide a sports bra which has a storage pouch of waterproof material with its smooth surface between its stitched surface and the wearer so as to reduce the likelihood of moisture penetrating the pouch. Yet another object of this invention is to provide a sports bra which has a storage pouch of waterproof material which overlaps its absorbent liner so as to reduce the possibility of perspiration migrating in the liner to the pouch.

SUMMARY OF THE INVENTION

In accordance with the invention, a sports bra is provided in which a front portion of the bra has a lining with a pair of bra cups symmetrically spaced from a cleavage axis and a decorative cloth matched to the contour of the lining. The lining lays face-to-face over the decorative cloth. A flat, open-topped pocket lays over the opposite side of the lining as the decorative cloth. The vertical centerline of the pocket is parallel to and the pocket covers the cleavage axis. A cloth cover lays over the pocket and extends beyond the side edges and bottom of the pocket. The bottom of the pocket is seamed to the bottom of the cover without stitching the lining and the decorative cloth and the sides of the cover are seamed to the lining without stitching the pocket and the decorative cloth so that the pocket can float in relation to the lining and decorative cover. Most preferably, the sides of the cover are seamed to the lining by flat seaming with TEX 24 or TEX 27 thread. This size thread is strong enough to withstand pulling on the pocket during use yet thin enough to be not easily observed. Preferably, the lining is of universally stretchable absorbent material, the decorative cloth is of universally stretchable wicking material and the cover is of universally stretchable absorbent material. The stretch affords the desired support from the bra, the absorbency collects the wearer's perspiration and the wicking draws the absorbed moisture to the outside for evaporation. The floating chamber of the pocket provides a comfortable pouch for concealing various articles within the bra.

It is preferred that an elastic band be stitched while under tension to the portion of the lining and decorative cloth extending along the cleavage axis and on the opposite side of the lining from the decorative cloth. The band gathers the lining and decorative cloth simultaneously in the direction of the cleavage axis to disguise the pocket and its contents. Preferably, the pocket is a piece of cloth folded end-to-end and seamed on an axis centered between its folds and folded at its bottom over itself. The seamed axis is aligned with the cleavage axis in the bra. Since the sides of the pocket have no seams, and since its only seam is aligned with the material gathered on the cleavage axis, the pocket is more easily concealed. The flat pocket has an open top and a segment of hook material stitched along the upper inside edge of the wall of the pocket adjacent the cover is matable with a mating segment of loop material stitched along the upper inside edge of the wall of the pocket not adjacent the cover to close the pocket. The pocket is preferably made of waterproof material to protect its contents from moisture. The top of the wall of the pocket adjacent the pocket cover may be seamed over the top of the pocket cover to prevent migration of moisture from the cover into the pocket.

Another lining face-to-face with a decorative cloth forms the back panel of the bra. The front lining, front decorative cloth, back panel lining and back panel decorative cloth are all seamed to each other at their side edges to form a single garment. The front lining and front decorative cloth may include front straps extending upwardly from each of the cups and the back lining and back decorative cloth may include back straps extending upwardly to the front straps with corresponding ends of the front and back straps seamed together. In the unstrapped embodiment of the sports bra, bands of elastic are seamed in folded-over-top and bottom edges of the garment with the decorative cloths to the outside of the folds and with the top edge of the wall of the pocket not adjacent the cover stitched into the top seam. In the strapped embodiment of the sports bra, the bands of elastic are seamed in folded-over bottom, neckline and shoulder edges of the garment with the decorative cloths to the outside of the folds and with the top edge of the wall of the pocket not adjacent the cover stitched into the neckline seam. Preferably, the back lining is of universally stretchable absorbent material and the back decorative cloth is of universally stretchable wicking material for the reasons hereinbefore noted.

In making the sports bra, the lining is cut to the contour of a pair of bra cups symmetrically spaced from a cleavage axis and a decorative cloth is cut to the contour of the lining. The lining is laid face-to-face over the decorative cloth. The flat, open-topped pocket is laid over the opposite side of the lining as the decorative cloth with the vertical centerline of the pocket parallel to and the pocket covering the cleavage axis. A cloth cover is laid over the pocket, the cover extending beyond the side edges and bottom of the pocket. The bottom of the pocket is seamed to the bottom of the cover without stitching the lining and the decorative cloth and the sides of the cover are seamed to the lining without stitching the pocket and the decorative cloth, preferably by flat seaming with the TEX 24 or TEX 27 thread. Preferably, the top of the wall of the pocket adjacent the pocket cover is seamed over the top of the pocket cover and the hook and loop material is stitched to opposite inside walls of the pocket.

If the gathered front is desired, the elastic band is laid over the portion of the lining along the cleavage axis of the bra and on the opposite side from the decorative cloth. The elastic band, lining and decorative cloth are stretched simultaneously in the direction of the cleavage axis. The stretched band, lining and decorative cloth are seamed together and then released to gather. This is done prior to laying the pocket over the lining. If the preferred embodiment of the pocket is to be used, the pocket is formed prior to laying the pocket over the lining by folding a piece of cloth end-to-end with the ends overlapping on an axis centered between the folds, seaming the ends of the folded cloth together to form a flat sleeve having side edges at the folds and folding the bottom of the sleeve over itself to form a flat pocket with an open top. Most preferably, when laying the pocket over the lining, the sleeve seam is aligned with the cleavage axis.

The back panel is formed by cutting a lining to the contour of the back panel and cutting a decorative cloth to the contour of the back lining. The back lining is laid face-to-face over the back decorative cloth. The front lining, front decorative cloth, back lining and back decorative cloth are all seamed to each other at their side edges into a single garment. The bands of elastic are then seamed in folded-over top and bottom or bottom, neckline and shoulder edges of the garment with the decorative cloths to the outside of the folds and with the top edge of the wall of the pocket not adjacent the cover stitched into the top seam.

This method allows the sports bra to be uniformly made with consistent, neat hems, seams and gathers while providing an attractive, sturdy, reliable source of support.

BRIEF DESCRIPTION OF THE DRAWINGS

Other objects and advantages of the invention will become apparent upon reading the following detailed description and upon reference to the drawings in which:

FIG. 2 is a cross-sectional view taken along the line 2—2 of FIG. 1;

FIG. 6 is a rear elevation view of a preferred embodiment of the floating pocket of the sports bra in a laid-out condition;

FIG. 7 is a front elevation view of the floating pocket of FIG. 6 in its folded condition;

FIG. 12 is a cross-sectional view taken along the line 12—12 of FIG. 10.

While the invention will be described in connection with a preferred embodiment and method, it will be understood that it is not intended to limit the invention to that embodiment and method. On the contrary, it is intended to cover all alternatives, modifications and equivalents as may be included within the spirit and scope of the invention as defined by the appended claims.

DETAILED DESCRIPTION

Figure 3:
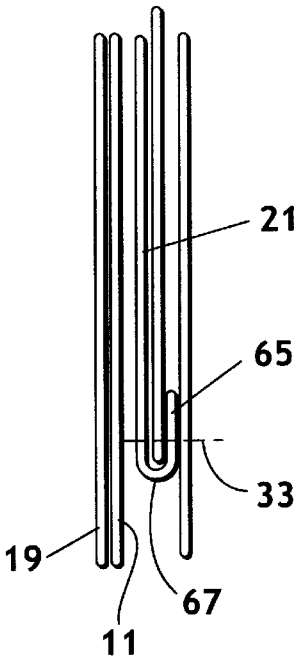
FIG. 3 is a cross-sectional view taken along the line 3—3 of FIG. 1.
Figure 1:
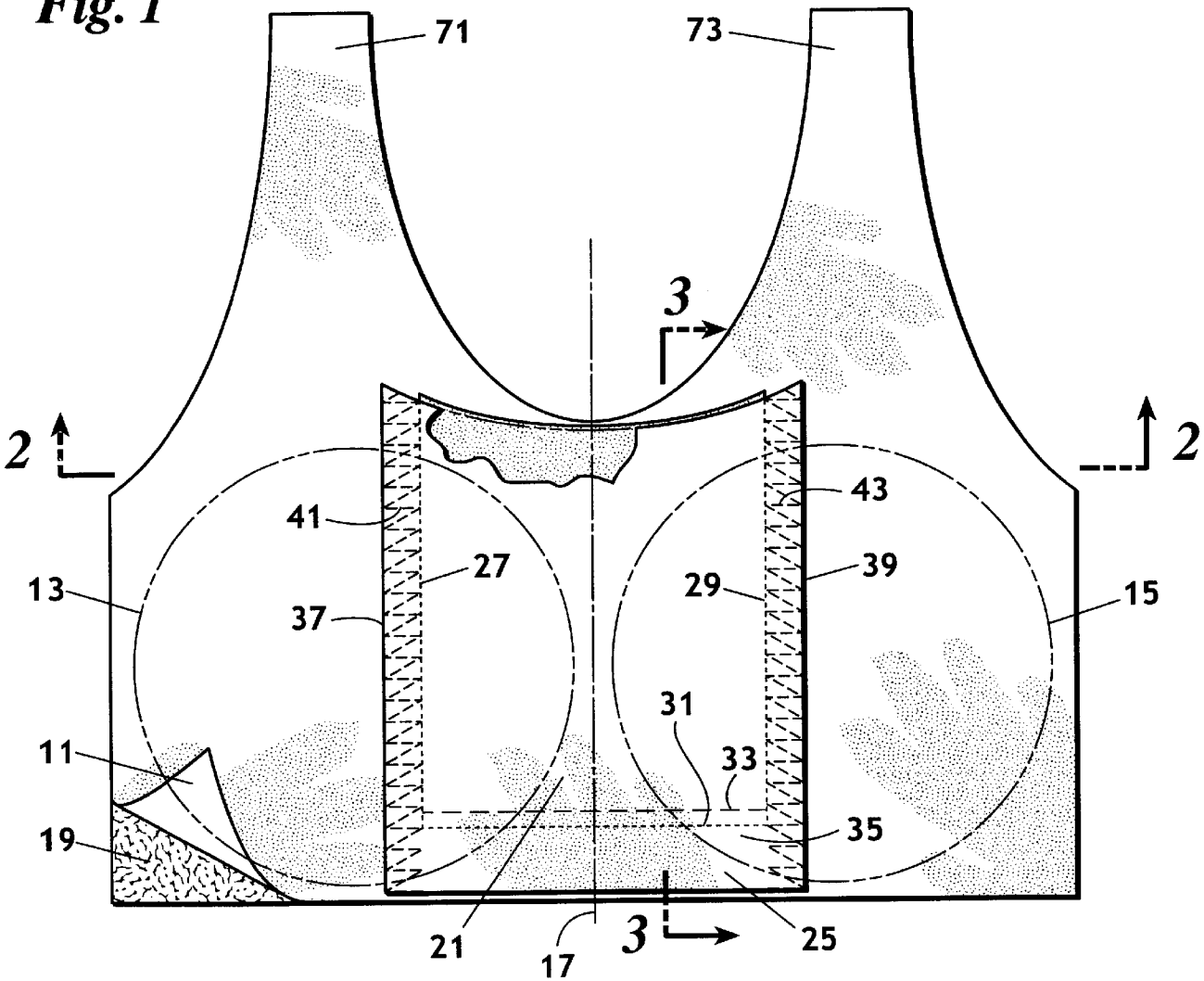
FIG. 1 is a rear elevation view of the front of the sports bra before seaming and elasticizing.

Turning first to FIGS. 1–3, a front portion of a sports bra has a lining 11 cut to a contour of a pair of bra cups 13 and 15 symmetrically spaced from a cleavage axis 17. A decorative cloth 19 is cut to the contour of the lining 11. The lining 11 is laid face-to-face over the decorative cloth 19. A flat, open-topped pocket 21 is laid over the opposite side of the lining 11 as the decorative cloth 19. The vertical center line 23 of the pocket 21 is, as shown, aligned in a vertical plane with the cleavage axis 17. The pocket 21 overlays or covers the cleavage axis 17. A cloth cover 25 is laid over the pocket 21 with the cover 25 extending beyond the side edges 27 and 29 and the bottom 31 of the pocket 21. The bottom 31 of the pocket 21 is seamed 33 to the bottom 35 of the cover without allowing the stitching of the seam 33 to secure the lining 11 or the decorative cloth 19 to the bottom 31 of the pocket 21 or the bottom 35 of the cover 25. The sides 37 and 39 of the cover 25 are seamed 41 and 43 to the lining 11 without stitching the pocket 21 or the decorative cloth 19 to the cover 25. Since the sides 27 and 29 of the pocket 21 are not secured to any part of the bra and since the bottom 31 of the pocket 21 is secured only to the bottom 35 of the cover 25, the pocket 21 is free to float in relation to the lining 11 and decorative cloth 19 of the bra. It is preferred that the lining 11 be of universally stretchable absorbent material such as CoolMax® by DuPont, the decorative cloth 19 be of universally stretchable wicking material such as Tactel® with Lycra® by DuPont and that the cover 25 be of universally stretchable absorbent material such as CoolMax® by DuPont. Thus, the lining 11 can collect perspiration from the body of the wearer and the decorative layer 19 can wick the collected moisture to the outer surface for evaporation. Similarly, the absorbent cover 25 can collect perspiration from the wearer while the waterproof pocket 21 generally protects the contents of the pouch from moisture.

Figure 4:
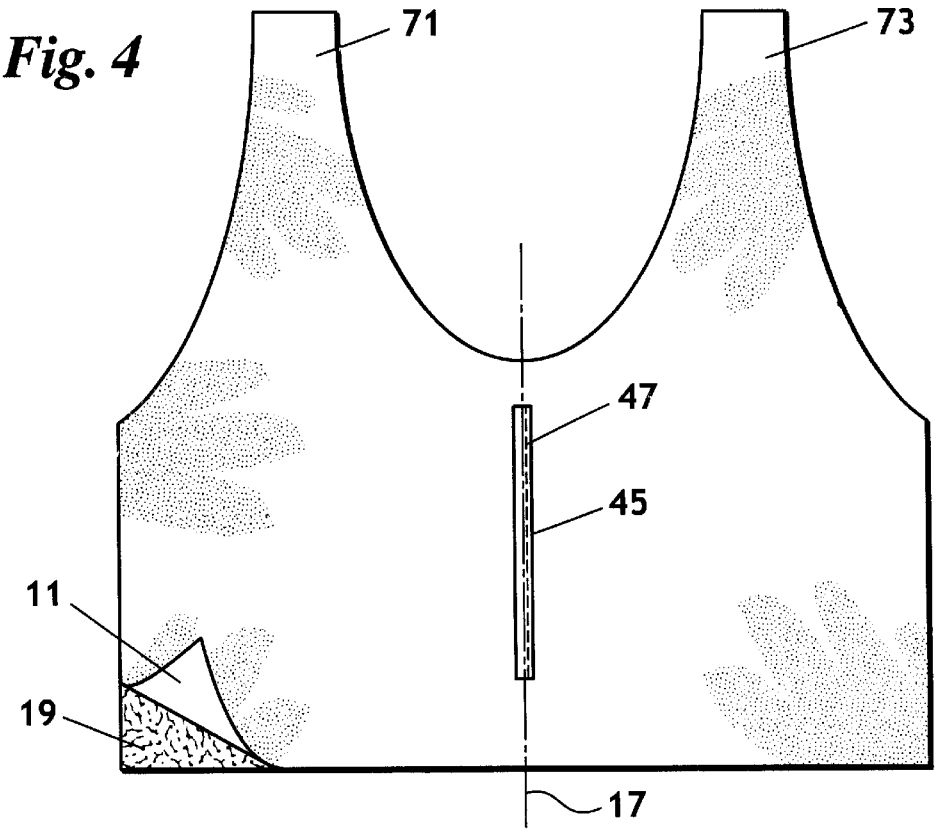
FIG. 4 is a rear elevation view of a preferred embodiment of the sports bra partially assembled with its cleavage material ungathered.
Figure 5:
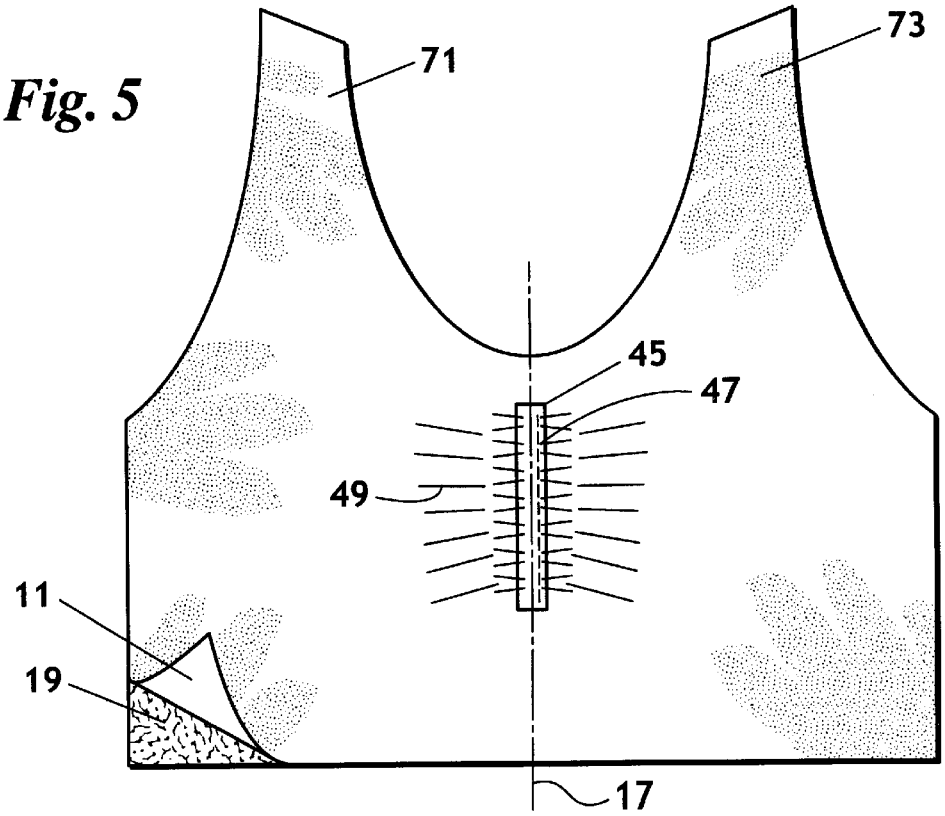
FIG. 5 is a rear elevation view of the embodiment of the sports bra of FIG. 4 with its cleavage material gathered.

Looking at FIGS. 4 and 5, the portion of the lining 11 and decorative cloth 19 in the area of the cleavage axis 17 can be gathered to further disguise the presence of the pocket 21 and its contents. An elastic band 45 is laid over the portion of the lining 11 along the cleavage axis 17 and on the opposite side of the lining 11 from the decorative cloth 19. As shown in FIG. 4, the elastic band 45, the lining 11 and the decorative cloth 19 are simultaneously stretched in the direction of the cleavage axis 17 and seamed 47 to secure the band 45, the lining 11 and the decorative cloth 19 together. After stitching, the seam 47, the band 45, lining 11 and decorative cloth 19 can be released, as shown in FIG. 5, resulting in the gather 49.

Turning now to FIGS. 6 and 7, the manner of making the preferred embodiment of the pocket 21 illustrated in FIGS. 1–3 is explained. A piece of cloth 51, preferably waterproof, is folded end-to-end 53 to 55 along parallel fold lines 57 and 59, preferably with the ends 53 and 55 overlapping on an axis 61 centered between the folds 57 and 59. The overlapped ends 53 and 55 are seamed 63 to form a flat sleeve having side edges at the folds 57 and 59. Alternative seaming methods can be employed. The bottom 65 of the sleeve is folded over itself along a bottom fold line 67 to form the flat pocket 21 with an open top 69. Returning to FIGS. 1–3, the pocket 21 thus formed is sewn in place as hereinbefore described with the bottom seam 33 closing the bottom 31 of the pocket 21 at the same time that the bottom 31 of the pocket 21 is fastened to the bottom 35 of the cover 25. If the gather 49 illustrated in FIG. 5 is to be used in the sports bra, the gather 49 is made before the pocket 21 is installed.

Figure 8:
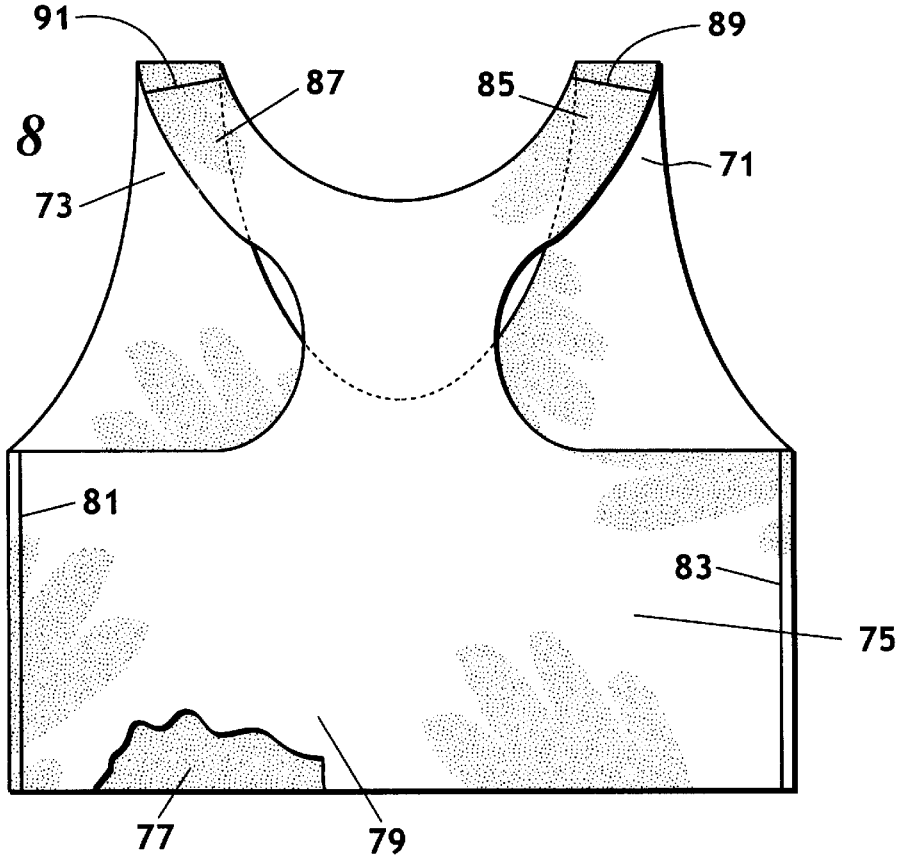
FIG. 8 is a rear elevation view of the front and back portions of the sports bra seamed together.
Figure 9:
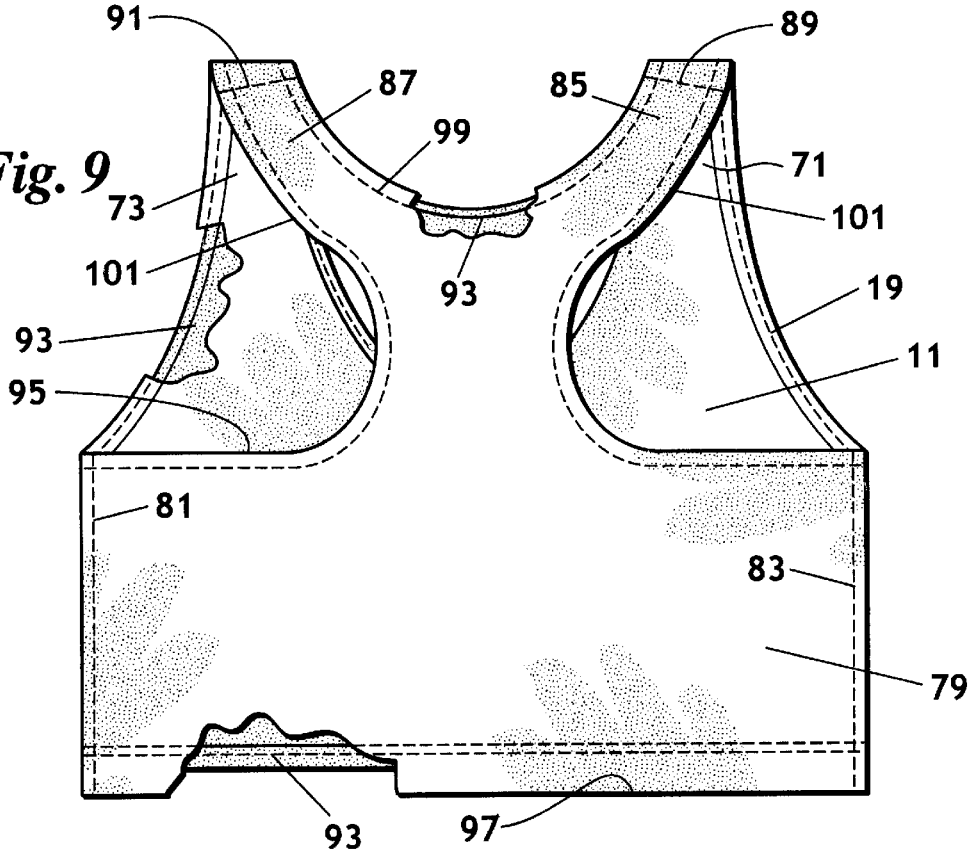
FIG. 9 is a rear elevation view of the sports bra of FIG. 8 after the edges have been elasticized.

Continuing to examine FIGS. 1–3, it is preferred that the bra have front straps 71 and 73 extending upwardly from each of the cups 13 and 15. Looking at FIGS. 8 and 9, in the strapped bra embodiment, a back panel 75 is formed by cutting a back lining 77 to the desired back contour and cutting a decorative cloth 79 to the same contour as the back lining 77. The back lining 77 is laid over the back decorative cloth 79. The front lining 11, the front decorative cloth 19, the back lining 77 and the back decorative cloth 79 are all seamed at their side edges 81 and 83 into a single garment. Like the front lining and decorative cloth 11 and 19, the back lining and decorative cloth 77 and 79 are preferably of universally stretchable absorbent material and wicking material, respectively. In the strapped embodiment of the bra, the back lining 77 and back decorative cloth 79 have back straps 85 and 87 which extend upwardly to the front straps 71 and 73 with seams 89 and 91 connecting the ends of the corresponding straps 71 and 85 and 73 and 87 into a single garment. Preferably, the gather 49, if desired, and the pocket 21 and cover 25 will have been secured as hereinbefore described before assembling the back and front portions of the bra into a single garment. Once the front and back portions have been assembled together, as shown in FIG. 9, bands of elastic 93 can be seamed in folded over top and bottom edges 95 and 97 or, in the strapped embodiment of the bra, bottom 97, neckline 99 and shoulder 101 edges of the garment with the decorative cloths 19 and 79 to the outside of the folds.

Figure 11:
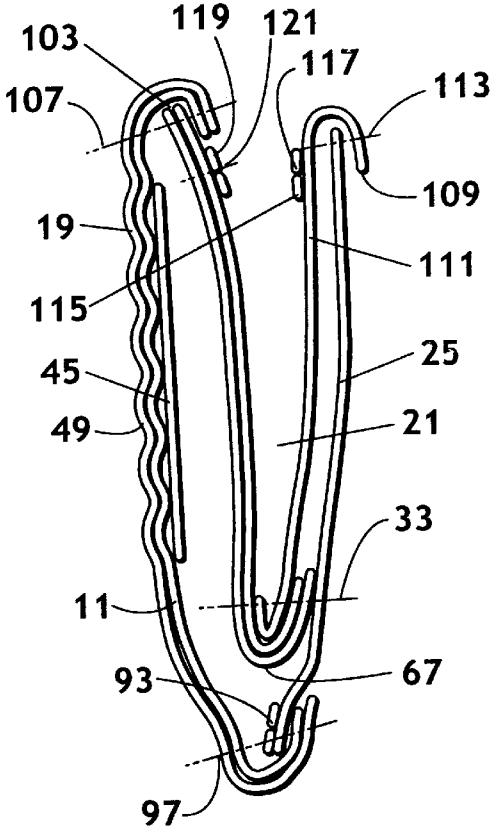
FIG. 11 is a cross-sectional view taken along the line 11—11 of FIG. 10.
Figure 10:
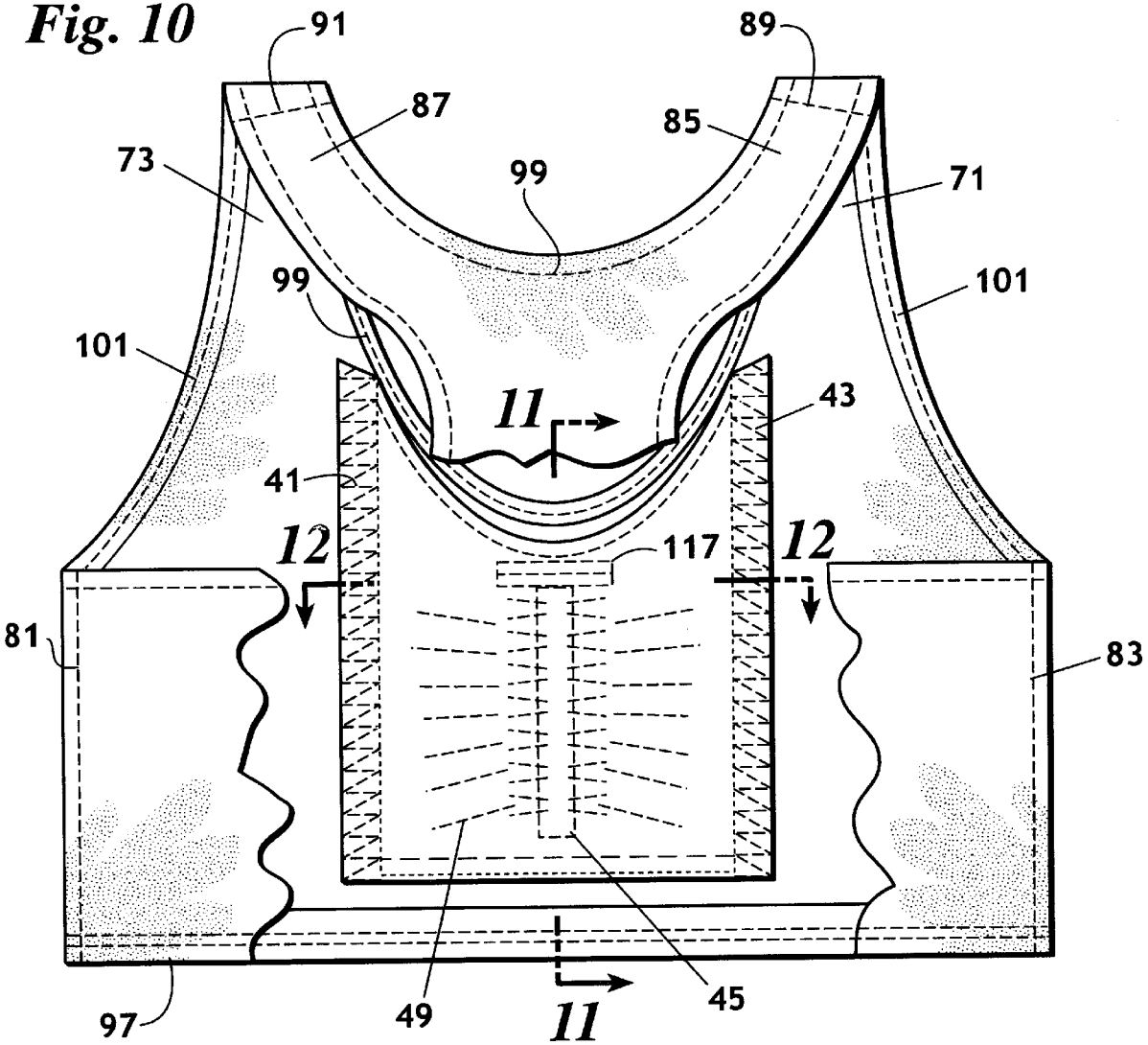
FIG. 10 is a rear elevation view of a completed preferred embodiment of the sports bra with parts broken away.

As is best seen in FIGS. 10–12, in seaming the bands 93 the top edge 103 of the wall 105 of the pocket 21 which is not adjacent the cover 25 is stitched into the neckline seam 107. Furthermore, the top edge 109 of the wall 111 of the pocket 21 which is adjacent to the pocket cover 25 is seamed 113 over the top 115 of the cover 25. This overlap of the waterproof material prevents moisture from migrating in the absorbent pocket cover 25 into the interior of the pocket 21. A segment of hook material 117 stitched 119 along the upper inside edge of the wall 111 of the pocket 21 adjacent the cover 25 mates with a segment of looped material 119 stitched 121 along the upper inside edge of the wall 105 of the pocket 21 not adjacent the cover 25 to close the pocket 21. The stretch provided by the gather 49 helps to absorb the pulling forces applied in opening the pocket 21.

Preferably, the seams 41 and 43 securing the cover 25 to the lining 11 are flat seams using thread sizes TEX 24 or TEX 27. The use of TEX 24 or TEX 27 thread has been found to provide the necessary strength to withstand the rigors of the pulls and stretches associated with opening and closing the pocket 21 while at the same time being sufficiently thin as to be difficult to observe. The flat seams 41 and 43 also inhibit unraveling of the cover 25.

Thus, it is apparent that there has been provided, in accordance with the invention, a sports bra and method of making the sports bra that fully satisfy the objects, aims and advantages set forth above. While the invention has been described in conjunction with a specific embodiment and method, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method of making a front portion of a sports bra comprising the steps of:

cutting a lining to a contour of a pair of bra cups symmetrically spaced from a cleavage axis;

cutting an outer decorative cloth to the contour of the lining;

laying the lining face-to-face over the decorative cloth;

laying an elastic band over a portion of the lining along the cleavage axis of the bra and on the opposite side from the decorative cloth;

stretching the elastic band, lining and decorative cloth simultaneously in the direction of the cleavage axis;

seaming the stretched band, lining and decorative cloth together;

releasing the seamed band, lining and decorative cloth to gather;

folding a piece of material end-to-end with the ends overlapping on an axis parallel to the folds;

seaming the ends of the waterproof material together to form a flat sleeve having side edges at the folds;

folding the bottom of the sleeve over itself to form a flat pocket with an open top;

laying the seamed surface of the pocket over the lining with the seam parallel to and centered on the elastic band;

laying a cover of absorbent material over the unseamed surface of the pocket, the cover extending beyond the side edges and bottom of the pocket;

seaming the bottom of the pocket to the bottom of the cover without stitching the lining and the decorative cloth; and seaming the sides of the cover to the lining without stitching the pocket and the decorative cloth.

2. A method of making a sports bra comprising the steps of:

cutting a lining to a contour of a pair of bra cups symmetrically spaced from a cleavage axis with front straps extending upwardly from each of the cups;

cutting an outer decorative cloth to the contour of the lining;

laying the lining face-to-face over the decorative;

laying an elastic band over a portion of the lining along the cleavage axis of the bra and on the opposite side from the decorative cloth;

stretching the elastic band, lining and decorative cloth simultaneously in the direction of the cleavage axis;

seaming the stretched band, lining and decorative cloth together;

releasing the seamed band, lining and decorative cloth to gather;

folding a piece of material end-to-end with the ends overlapping on an axis parallel to the folds;

seaming the ends of the folded material together to form a flat sleeve having side edges at the folds;

folding the bottom of the sleeve over itself to form a flat pocket with an open top;

laying the seamed surface of the pocket over the lining with the seam parallel to and centered on the elastic band;

laying a cover of absorbent material over the unseamed surface of the pocket, the cover extending beyond the side edges and bottom of the pocket;

seaming the bottom of the pocket to the bottom of the cover without stitching the lining and the decorative cloth;

seaming the sides of the cover to the lining without stitching the pocket and the decorative cloth;

cutting a lining to a contour of a back panel with back straps extending upwardly therefrom;

cutting an outer decorative cloth to the contour of the back lining;

laying the back lining face-to-face over the back decorative;

seaming the front lining, front decorative cloth, back lining and back decorative cloth at their side edges and front and back strap ends into a single garment; and seaming bands of elastic in folded-over bottom, neckline and shoulder edges of the garment with the decorative cloths to the outside of the folds and with the top edge of the seamed wall of the pocket in the neckline seam.

3. A front portion of a sports bra comprising:

a lining having a pair of bra cups symmetrically spaced from a cleavage axis;

a decorative cloth matching a contour of said lining, said lining laying face-to-face over said decorative cloth;

a flat, open-topped pocket laying over an opposite side of said lining as said decorative cloth with a vertical centerline of said pocket parallel to and said pocket covering said cleavage axis;

a cloth cover laying over said pocket, said cover extending beyond side edges and a bottom of said pocket;

said bottom of said pocket being seamed to a bottom of said cover without stitching said lining and said decorative cloth; and said sides of said cover being seamed to said lining without stitching said pocket and said decorative cloth.

4. A front portion of a sports bra according to claim 3, said lining being of universally stretchable absorbent material.

5. A front portion of a sports bra according to claim 3, the decorative cloth being of universally stretchable wicking material.

6. A front portion of a sports bra according to claim 3, said cover being of universally stretchable absorbent material.

7. A front portion of a sports bra according to claim 3 further comprising an elastic band stitched while under tension to a portion of said lining and said decorative cloth along said cleavage axis on an opposite side from said decorative cloth and gathering said lining and said decorative cloth simultaneously in the direction of said cleavage axis.

8. A front portion of a sports bra according to claim 3, said pocket comprising a piece of cloth folded end-to-end and seamed on an axis centered between said folds and folded at its bottom over itself to form a flat pocket having an open top.

9. A front portion of a sports bra according to claim 8, said pocket being of waterproof material.

10. A front portion of a sports bra according to claim 8, said seamed axis being aligned with said cleavage axis.

11. A front portion of a sports bra according to claim 3, said lining and said decorative cloth having front straps extending upwardly from each of said cups.

12. A front portion of a sports bra according to claim 3 further comprising a lining face-to-face with a decorative cloth to form a back panel, said front lining, front decorative cloth, back panel lining and back panel decorative cloth being seamed at their side edges into a single garment.

13. A front portion of a sports bra according to claim 12, said back lining being of universally stretchable absorbent material.

14. A front portion of a sports bra according to claim 12, said back decorative cloth being of universally stretchable wicking material.

15. A front portion of a sports bra according to claim 12 further comprising bands of elastic seamed in folded-over top and bottom edges of said garment with said decorative cloths to an outside of said folds and with a top edge of a wall of said pocket not adjacent said cover stitched into said top seam.

16. A front portion of a sports bra according to claim 12, said front lining and said front decorative cloth having front straps extending upwardly from each of said cups and said back lining and said back decorative cloth having back straps extending upwardly to said front straps with corresponding ends of said front and back straps being seamed together.

17. A front portion of a sports bra according to claim 16 further comprising bands of elastic seamed in folded-over bottom, neckline and shoulder edges of said garment with said decorative cloths to the outside of said folds and with a top edge of a wall of said pocket not adjacent said cover stitched into said neckline seam.

18. A front portion of a sports bra according to claim 3 a top of a wall of said pocket adjacent said pocket cover being seamed over a top of said pocket cover.

19. A front portion of a sports bra according to claim 3 further comprising:

a segment of hook material stitched along an upper inside edge of a wall of said pocket adjacent said cover; and a mating segment of loop material stitched along an upper inside edge of a wall of said pocket not adjacent said cover.

20. A front portion of a sports bra according to claim 3, sides of said cover being seamed to said lining by flat seaming with thread size of one of TEX 24 and TEX 27.

21. A front portion of a sports bra comprising:

a lining having a pair of bra cups symmetrically spaced from a cleavage axis;

an outer decorative cloth matching a contour of said lining, said lining laying face-to-face over said decorative cloth;

an elastic band stitched while under tension to a portion of said lining and said decorative cloth along said cleavage axis on an opposite side from said decorative cloth and gathering said lining and said decorative cloth simultaneously in the direction of said cleavage axis;

a piece of material folded end-to-end and seamed on an axis parallel to said folds and folded at its bottom over itself to form a flat pocket having an open top, said seamed surface of said pocket laying over said lining with said seam parallel to and centered on said elastic band; and a cover of absorbent material laid over an unseamed surface of said pocket, said cover extending beyond side edges and a bottom of said pocket, and said bottom of said pocket being seamed to said bottom of said cover without stitching said lining and said decorative cloth and said sides of said cover being seamed to said lining without stitching said pocket and said decorative cloth.

22. A sports bra comprising:

a lining having a pair of bra cups symmetrically spaced from a cleavage axis with front straps extending upwardly from each of said cups;

an outer decorative cloth matching a contour of said lining, said lining laying face-to-face over said decorative cloth;

an elastic band stitched while under tension to a portion of said lining and said decorative cloth along said cleavage axis on an opposite side from said decorative cloth and gathering said lining and said decorative cloth simultaneously in the direction of said cleavage axis;

a piece of material folded end-to-end and seamed on an axis parallel to said folds and folded at its bottom over itself to form a flat pocket having an open top, said seamed surface of said pocket laying over said lining with said seam parallel to and centered on said elastic band;

a cover of absorbent material laid over an unseamed surface of said pocket, said cover extending beyond said side edges and a bottom of said pocket, said bottom of said pocket being seamed to said bottom of said cover without stitching said lining and said decorative cloth and said sides of said cover being seamed to said lining without stitching said pocket and said decorative cloth;

a back lining having a panel with straps extending upwardly therefrom;

an outer decorative back cloth matching a contour of said back lining, said back lining laying face-to-face over said back decorative cloth;

said front lining, front decorative cloth, back lining and back decorative cloth being seamed at side edges thereof and at ends of said front and back straps into a single garment; and bands of elastic seamed in folded-over bottom, neckline and shoulder edges of said garment with said decorative cloths to an outside of said folds and with a top edge of a seamed wall of said pocket in said neckline seam.

23. A method of making a front portion of a sports bra comprising the steps of:

cutting a lining to a contour of a pair of bra cups symmetrically spaced from a cleavage axis;

cutting a decorative cloth to the contour of the lining;

laying the lining face-to-face over the decorative cloth;

laying a flat, open-topped pocket over the opposite side of the lining as the decorative cloth with the vertical centerline of the pocket parallel to and the pocket covering the cleavage axis;

laying a cloth cover over the pocket, the cover extending beyond the side edges and bottom of the pocket;

seaming the bottom of the pocket to the bottom of the cover without stitching the lining and the decorative cloth; and seaming the sides of the cover to the lining without stitching the pocket and the decorative cloth.

24. A method according to claim 23, the lining being of universally stretchable absorbent material.

25. A method according to claim 23, the decorative cloth being of universally stretchable wicking material.

26. A method according to claim 23, the cover being of universally stretchable absorbent material.

27. A method according to claim 23 further comprising, prior to said step of laying the pocket over the lining, the steps of:

laying an elastic band over a portion of the lining along the cleavage axis of the bra and on the opposite side from the decorative cloth;

stretching the elastic band, lining and decorative cloth simultaneously in the direction of the cleavage axis;

seaming the stretched band, lining and decorative cloth together; and releasing the seamed band, lining and decorative cloth to gather.

28. A method according to claim 23 further comprising, prior to said step of laying the pocket over the lining, the steps of:

folding a piece of cloth end-to-end with the ends overlapping on an axis centered between the folds;

seaming the ends of the folded cloth together to form a flat sleeve having side edges at the folds; and folding the bottom of the sleeve over itself to form a flat pocket with an open top.

29. A method according to claim 28, the pocket being of waterproof material.

30. A method according to claim 28, said step of laying the pocket over the lining further comprising the substep of aligning the sleeve seam with the cleavage axis.

31. A method according to claim 23, the lining and the decorative cloth having front straps extending upwardly from each of the cups.

32. A method according to claim 23 further comprising the steps of:

cutting a lining to a contour of a back panel;

cutting a decorative cloth to the contour of the back lining;

laying the back lining face-to-face over the back decorative cloth; and seaming the front lining, front decorative cloth, back lining and back decorative cloth at their side edges into a single garment.

33. A method according to claim 32, the back lining being of universally stretchable absorbent material.

34. A method according to claim 32, the back decorative cloth being of universally stretchable wicking material.

35. A method according to claim 32 further comprising the step of seaming bands of elastic in folded-over top and bottom edges of the garment with the decorative cloths to the outside of the folds and with the top edge of the wall of the pocket not adjacent the cover stitched into the top seam.

36. A method according to claim 32, the front lining and the front decorative cloth having front straps extending upwardly from each of the cups and the back lining and the back decorative cloth having back straps extending upwardly to the front straps, said step of seaming the front lining, front decorative cloth, back lining and back decorative cloth into a single garment further comprising the step of seaming the corresponding ends of the front and back straps together.

37. A method according to claim 36 further comprising the step of seaming bands of elastic in folded-over bottom, neckline and shoulder edges of the garment with the decorative cloths to the outside of the folds and with the top edge of the wall of the pocket not adjacent the cover stitched into the neckline seam.

38. A method according to claim 23 further comprising the step seaming the top of the wall of the pocket adjacent the pocket cover over the top of the pocket cover.

39. A method according to claim 23 further comprising the steps of:

stitching a segment of hook material along the upper inside edge of the wall of the pocket adjacent the cover; and stitching a mating segment of loop material along the upper inside edge of the wall of the pocket not adjacent the cover.

40. A method according to claim 23, said step of seaming the sides of the cover to the lining being accomplished by flat seaming with thread size of one of TEX 24 and TEX 27.

* * * * *